US009878207B2

(12) United States Patent
Brinkhaus et al.

(10) Patent No.: US 9,878,207 B2
(45) Date of Patent: Jan. 30, 2018

(54) PELVIC FLOOR TRAINING DEVICE

(71) Applicant: MSYS AG, Hergiswil (CH)

(72) Inventors: Bernhard Brinkhaus, Oetwil a. d. Limmat (CH); Marco Schuurmans Stekhoven, Zurich (CH)

(73) Assignee: MSYS AG, Hergiswil (CH)

( * ) Notice: Subject to any disclaimer, the term of this patent is extended or adjusted under 35 U.S.C. 154(b) by 191 days.

(21) Appl. No.: 14/443,001

(22) PCT Filed: Nov. 14, 2012

(86) PCT No.: PCT/EP2012/072560

§ 371 (c)(1),
(2) Date: May 14, 2015

(87) PCT Pub. No.: WO2014/075712

PCT Pub. Date: May 22, 2014

(65) Prior Publication Data

US 2015/0273270 A1 Oct. 1, 2015

(51) Int. Cl.

| | |
|---|---|
| ***A63B 71/00*** | (2006.01) |
| ***A63B 26/00*** | (2006.01) |
| ***A63B 24/00*** | (2006.01) |
| ***A63B 23/20*** | (2006.01) |
| ***A63B 21/045*** | (2006.01) |
| *A63B 71/06* | (2006.01) |

(52) U.S. Cl.

CPC ..... *A63B 24/0062* (2013.01); *A63B 21/045* (2013.01); *A63B 23/20* (2013.01); *A63B 2071/065* (2013.01); *A63B 2208/0233* (2013.01); *A63B 2220/51* (2013.01); *A63B 2220/56* (2013.01)

(58) Field of Classification Search

USPC ..... 482/1–9

See application file for complete search history.

(56) References Cited

U.S. PATENT DOCUMENTS

| | | | | |
|---|---|---|---|---|
| 5,483,832 | A * | 1/1996 | Pauser | A61B 5/227 600/591 |
| 7,473,214 | B2 * | 1/2009 | Schuurmans Stekhoven | A63B 23/20 482/142 |
| 7,497,816 | B2 | 3/2009 | Li | |
| 2007/0287610 | A1 * | 12/2007 | Novak | A61H 19/00 482/105 |

(Continued)

FOREIGN PATENT DOCUMENTS

| | | |
|---|---|---|
| AU | 5472480 | 7/1981 |
| CN | 1423540 | 6/2003 |

(Continued)

OTHER PUBLICATIONS

International Search Report For PCT/EP2012/072560, English translation attached to oringial, Both completed by the European Patent Office on Jul. 5, 2013, All together 5 Pages.

*Primary Examiner* — Sundhara Ganesan
*Assistant Examiner* — Shila Jalalzadeh Abyane
(74) *Attorney, Agent, or Firm* — Brooks Kushman P.C.

(57) ABSTRACT

The training device for training human pelvic floor muscles, intended to be placed for training externally onto the human body directly or indirectly between the two ischial bones while sitting, including a seat part and a pressure sensor device for detecting the muscle force.

14 Claims, 6 Drawing Sheets

(56) References Cited

U.S. PATENT DOCUMENTS

| | | | | |
|---|---|---|---|---|
| 2008/0139876 | A1* | 6/2008 | Kim | A61B 5/202<br>600/29 |
| 2010/0262049 | A1* | 10/2010 | Novak | A61H 19/00<br>601/46 |

FOREIGN PATENT DOCUMENTS

| | | |
|---|---|---|
| JP | 2006525043 | 11/2006 |
| JP | 2008000297 | 1/2008 |
| JP | 2014000252 | 1/2014 |
| WO | 2004045411 | 6/2004 |
| WO | 2005079926 | 9/2005 |
| WO | 2006061176 | 6/2006 |
| WO | 2012016005 | 2/2012 |

* cited by examiner

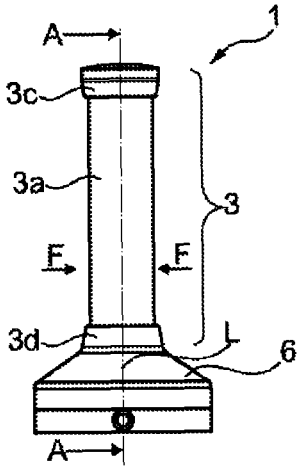
Fig. 1
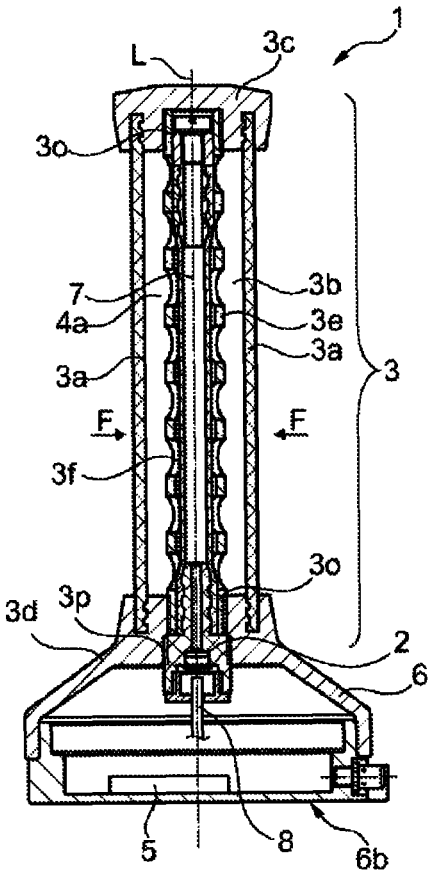
Fig. 2(A-A)

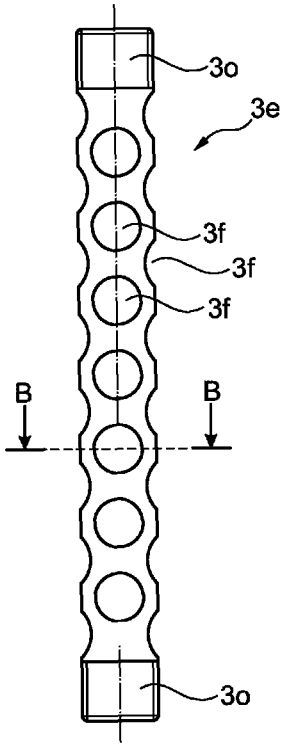
Fig. 3
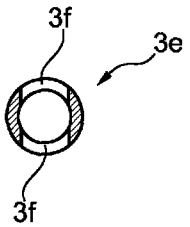
Fig. 4(B-B)
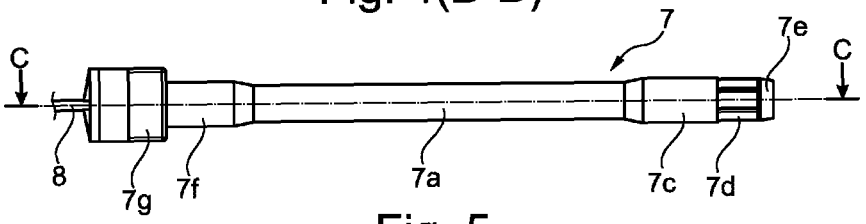
Fig. 5

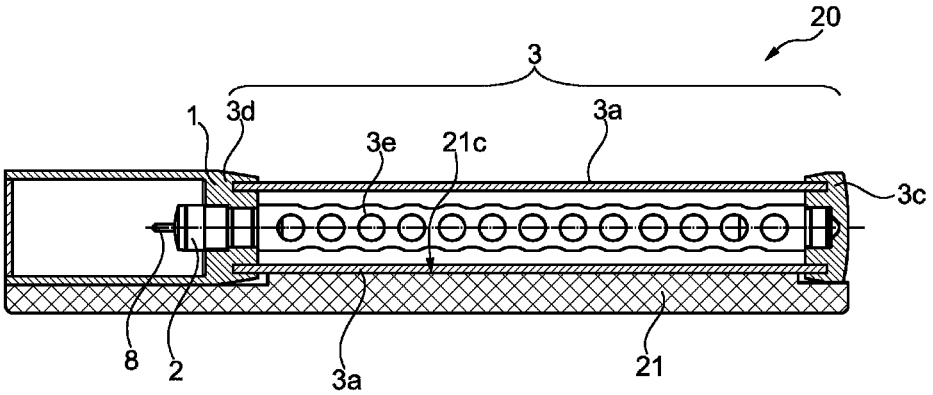
Fig. 13(D-D)
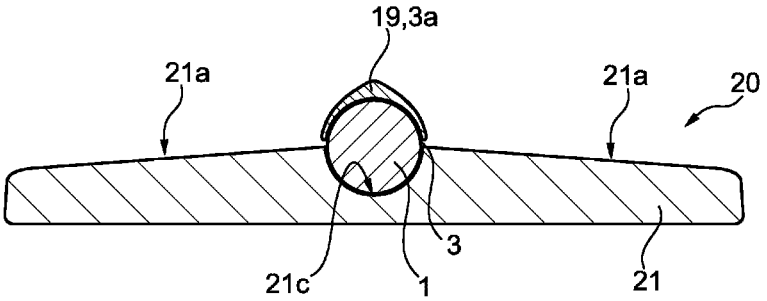
Fig. 14
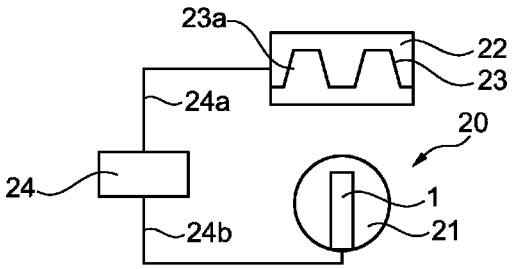
Fig. 15

PELVIC FLOOR TRAINING DEVICE

CROSS-REFERENCE TO RELATED APPLICATION

This application is the U.S. national phase of PCT Application No. PCT/EP2012/072560 filed on Nov. 14, 2012, the disclosure of which is incorporated in its entirety by reference herein.

TECHNICAL FIELD

The invention relates to a pelvic floor training device according to the preamble of claim 1.

BACKGROUND

Pelvic floor training devices are used to train the muscles of the human pelvic floor. Well trained pelvic floor muscles are important, for example, to ensure continence in men and women.

For example, a training device for training the pelvic floor muscles is known from EP 1 747 048 A1. This training device has proven of great use but has the disadvantage that the force acting on it cannot be measured very accurately.

WO 2004/045411 discloses another pelvic floor training device. The latter training device, integrated in a chair, is very difficult to operate, is inexact in terms of pressure measurement and, moreover, can normally be used only in urology practices.

DETAILED DESCRIPTION

The object of the present invention is to form a more advantageous training device for training the human pelvic floor muscles.

This object is achieved with a training device comprising the features of claim 1. Dependent claims 2 to 14 relate to further advantageous embodiments.

The object is achieved in particular with a training device for training human pelvic floor muscles, intended to be placed for training externally onto the human body directly or indirectly between the two ischial bones while seated, comprising a seat part, and comprising a pressure sensor for detecting the muscle force, wherein the pressure sensor comprises a pressure-measuring or force-measuring device and also a hollow body extending in a longitudinal direction, wherein the hollow body comprises an upper fixed end part, a lower fixed end part and a spacer element, wherein the upper end part and the lower end part are held spaced apart from each other by the spacer element, wherein the spacer element extends in the longitudinal direction, and wherein the hollow body comprises a flexible outer sheath which connects the upper end part to the lower end part in such a way that a closed inner space forms within which the spacer element is also arranged, wherein the inner space of the hollow body contains a gel material, an elastic multi-component material or a liquid material that acts as pressure mediator, and wherein the pressure-measuring or force-measuring device extends in the longitudinal direction at least partially within the inner space in order to transmit the pressure from the outer sheath to the pressure-measuring or force-measuring device via the pressure mediator.

The training device according to the invention for training human pelvic floor muscles comprises a seat part and also a pressure sensor for detecting the muscle force. In one advantageous embodiment, the seat part has a recess into which the pressure sensor can be placed, wherein the recess and the pressure sensor are designed matching each other in such a way that the hollow body of the pressure sensor protrudes at least partially above the seat surface of the seat part. This embodiment has the advantage that the pressure sensor can be easily removed from the seat part, for example in order to clean the pressure sensor. However, it may also prove advantageous to have several seat parts with recesses of different depths for the pressure sensor. It is thereby possible that, depending on the seat part used, the height of the pressure sensor protruding above the seat surface can be varied. In a preferred embodiment, the hollow body is rod-shaped and has a hollow cylindrical portion. However, the hollow body could also have an outer contour which, on the side facing the seat part, is designed matching the recess of the seat part and, on the opposite side, has a shape adapted to the human body, for example similar to the anatomy of the human body part placed on the seat. The training device according to the invention has the advantage that the forces effected by the human pelvic floor muscle can be measured reliably and in a reproducible manner. Moreover, the training device can be easily cleaned. Moreover, the training device can be easily adapted to differently shaped human bodies by a suitable combination of seat part and/or pressure sensor.

In one possible use, the pressure sensor can rest directly on the skin of a person who is training. However, a particular advantage of the training device according to the invention is that a person who is training can also train with the training device when fully clothed, by means of the fully clothed person sitting on the seat part. There is therefore no intimate contact between the person training and the pressure sensor, which greatly facilitates the use of the training device.

BRIEF DESCRIPTION OF THE DRAWINGS

FIG. 1 shows a side view of a pressure sensor;

FIG. 2 shows a longitudinal section through FIG. 1 along the section line A-A;

FIG. 3 shows a side view of a spacer element;

FIG. 4 shows a cross section through FIG. 3 along the section line B-B;

FIG. 5 shows a side view of a pressure-measuring device;

FIG. 13 shows a section through FIG. 11 along the section line D-D;

FIG. 14 shows a section through FIG. 11, perpendicular to the pressure sensor;

FIG. 15 shows a schematic view of a tracking device.

In the drawings, identical parts are in principle provided with identical reference signs.

SUMMARY

Figure 6:
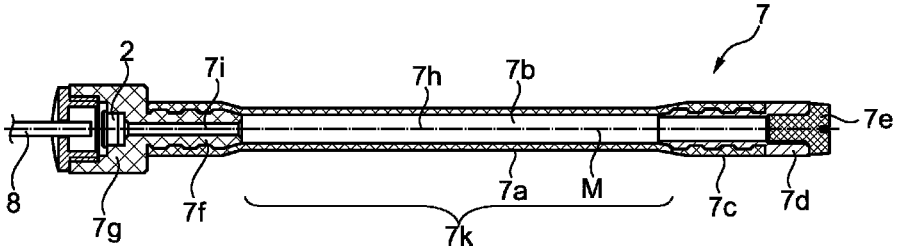
FIG. 6 shows a longitudinal section through the pressure-measuring device from FIG. 5 along the section line C-C.

FIG. 1 shows a pressure sensor 1 in a side view, and FIG. 2 shows same in a longitudinal section along the section line A-A. The pressure sensor 1 comprises a hollow body 3 extending in a longitudinal direction L, wherein the hollow body 3 comprises an upper fixed end part 3*c*, a lower fixed end part 3*d* and a spacer element 3*e*, wherein the upper end part 3*c* and the lower end part 3*d* are held spaced apart from each other by the spacer element 3*e*, wherein the spacer element 3*e* extends in the longitudinal direction L. The hollow body 3 comprises a flexible outer sheath 3*a* which connects the upper end part 3*c* to the lower end part 3*d* in such a way that a closed inner space 3*b* forms, in particular an inner space closed so as to be fluid-tight, within which the spacer element 3*e* is also arranged. The outer sheath 3*a* is designed in such a way that it can be placed directly or indirectly onto the human body. The upper end part 3*c* and lower end part 3*d* are of particular importance for precise measurement, since the upper end part 3*c* and lower end part 3*d* are fixed or rigid and prevent an excursion or an enlargement of the inner space 3*b* in the longitudinal direction L. The device 1 additionally comprises a pressure-measuring or force-measuring device 7 which extends in the longitudinal direction L within the inner space 3*b*. The inner space 3*b* of the hollow body 3 contains or is filled with a gel material 4*a*, an elastic multi-component material 4*a* or a liquid material 4*a* which acts as pressure mediator in order to transmit the pressure from the outer sheath 3*a* to the pressure-measuring or force-measuring device 7 via the pressure mediator. A closed inner space 3*b* is understood as an inner space 3*b* which is closed off from the outside in such a way that the pressure mediator, i.e. the gel material 4*a*, the elastic multi-component material 4*a* or the liquid material 4*a*, located in the inner space 3*b* cannot escape outward from the device 1. At least when a fluid is used as pressure mediator, the inner space 3*b* is thus closed off in a fluid-tight manner. In FIG. 2, the lower end part 3*d* has an aperture 3*p* which is designed as an internal thread, into which the pressure-measuring device 7 is screwed. The pressure-measuring device 7 is connected to the aperture 3*p* and/or designed in such a way that it is not possible for the pressure mediator to escape via the aperture 3*p*. The hollow body 3 thus encloses a closed inner space 3*b*, and any passages in the upper end part 3*c* and/or lower end part 3*d*, for example for electric cables or, as shown in FIG. 2, for securing the pressure-measuring device 7, are sealed off in order to form a closed inner space from which the pressure mediator cannot escape.

The spacer element 3*e*, which is shown in a side view in FIG. 3 and is shown in detail in FIG. 4 in a section along the section line B-B, is designed as a half tube with wall openings 3*f*, for example circular wall openings 3*f*, and comprises fastening portions 3*o* at the top and bottom, which fastening portions 3*o*, as is shown in FIG. 2, are firmly connected to the upper end part 3*c* and lower end part 3*d*, respectively, in order to hold the two end parts 3*c*, 3*d* at a defined distance from each other. The wall openings 3*f* or wall apertures can be designed in a great many shapes in order to ensure that, starting from the flexible outer sheath 3*a*, a pressure-conveying connection to the pressure-measuring or force-measuring device 7 can be made with the aid of the material located in the inner space 3*b*, e.g. a gel material 4*a*.

As is shown in FIG. 2, the pressure-measuring and force-measuring device 7 is inserted from underneath into the inner space of the spacer element 3*e* through the lower end part 3*d*, wherein the pressure-measuring or force-measuring device 7 is screwed onto the lower end part 3*d* and is thereby held secure. The pressure-measuring or force-measuring device 7 is shown in detail in FIGS. 5 and 6, where FIG. 5 shows a side view and FIG. 6 shows a section along the section line C-C. As can be seen from FIG. 6, the pressure-measuring or force-measuring device 7 comprises a flexible hollow body 7*a* extending in the direction of extent M and having an inner space 7*b*, wherein the flexible hollow body 7*a* has, on the right, an upper end portion 7*c*, which is connected firmly and preferably in a fluid-tight manner to an upper closure piece 7*d*. The opening of the upper closure piece 7*d* is closed with a screw 7*e*. The flexible hollow body 7*a* has, on the left, a lower end portion 7*f*, which is connected firmly and preferably in a fluid-tight manner to a lower closure piece 7*g*. A force transducer 2 is arranged in the lower closure piece 7*g*, wherein the lower closure piece 7*g* has a fluid-conveying channel 7*i*, which connects the inner space 7*b* to the force transducer 2. The inner space 2*b* and the fluid-conveying channel 2*i* are filled with a second liquid material 7*h*. The force transducer 2 has a surface which extends perpendicularly with respect to the direction of extent M and on which the second liquid material 7*h* bears, such that the force transducer 2 is coupled to the inner space 7*b* in a manner perpendicular to the direction of extent M in order to measure the pressure of the second liquid material 7*h*. The force transducer 2 is connected by a cable 8 to the electronics unit 5 shown in FIG. 2. The wall of the flexible, tubular hollow body 7*a* transmits a pressure force, acting externally along the portion 7*k*, to the liquid 7*h* located in the inner space 7*b*, wherein the force transducer 2 measures the pressure or the force applied by the liquid 7*h* to the force transducer 2. The hollow body 7*a* can transmit the force from the outside inward only along the portion 7*k*, since the hollow body 7*a* bears, along the upper end portion 7*c*, on the upper closure piece 7*d* and, along the lower end portion 7*f*, against the lower closure piece 7*g*. The screw 7*e* serves inter alia to completely fill the inner space 7*b* with the liquid 7*h* and thereafter to close the inner space 7*b* in a fluid-tight manner again. In an advantageous embodiment, the portion 7*k* of the flexible hollow body 7*a* has a Shore hardness in the range of between 10 and 20, in particular as a result of the second liquid material 7*h*. An oil, for example, is used as the liquid material 7*h*.

In a preferred embodiment, the force-measuring device 7, as shown in FIG. 2, extends along the entire length L of the inner space 3*b* and moreover also along the lower end part 3*d*, wherein the portion 7*k* extends only within the inner space 3*b*. In a further embodiment, the force-measuring device 7 could also be designed in such a way that it does not extend along the entire length L of the inner space 3*b* but instead, for example, only by half the length L, or for example by three quarters of the length L. In the most preferred configuration, the force-measuring device 7, as shown in FIG. 2, extends along the center or along the axis L. The force-measuring device 7 is, as shown, preferably centered with respect to the longitudinal axis, such that the forces applied to the flexible outer sheath 3*a* are transmitted uniformly to the pressure-measuring or force-measuring device 7. However, the pressure-measuring or force-measuring device 7 could also be arranged extending eccentrically in the inner space 7*b*.

In a particularly advantageous embodiment, the flexible outer sheath 3*a*, as shown in FIGS. 1 and 2, is designed in the shape of a hollow cylinder. The flexible outer sheath 3*a* is preferably made of silicone, vulcanized rubber or unvulcanized rubber. The gel material 4*a* acting as pressure mediator, the elastic multi-component material 4*a* or the liquid material 4*a* transmits the pressure from the outer sheath 3*a* to the pressure-measuring or force-measuring device 7. When being introduced into the inner space 3*b*, the pressure mediator is advantageously introduced with a predetermined pressure, such that the pressure mediator in a rest state, that is to say without any force acting on the outer sheath 3*a*, has a predetermined pressure. The predetermined filling pressure of the pressure mediator influences the hardness or the pliability of the flexible outer sheath 3*a*. In a particularly advantageous embodiment, the flexible outer sheath 3*a* is chosen to be of such a material and/or the predetermined pressure of the pressure mediator is chosen in such a way that the flexible outer sheath 3*a* has a Shore hardness in the range of between 20 and 90. The following, among other things, can be achieved in this way: Firstly, the flexible outer sheath 3*a* feels comfortable on the applied body part, which is achieved by the fact that the flexible outer sheath 3*a* or the pressure mediator has certain elastic properties. These elastic properties, which are felt comfortable by the body part, have the advantage that no pressure sores occur on the body part bearing directly or indirectly on the device. A hard outer sheath 3*a* could cause pressure sores on an applied body part, of which a possible consequence could be that the training of the pelvic floor muscle is not carried out at all, or is carried out only incompletely, because of the unpleasant feeling and/or on account of pain. The avoidance of such pressure sores is therefore of crucial importance for the training of the pelvic floor muscle. Secondly, it is particularly advantageous if the diameter of the flexible outer sheath 3*a* is only slightly changed, even under quite considerable forces, the reason being that, for the body part resting on the outer sheath 3*a*, it becomes more difficult to exert great force on the outer sheath 3*a* the smaller the diameter of the flexible outer sheath 3*a*. In a particularly advantageous embodiment, the device according to the invention thus has the advantage that the aforementioned properties of the outer sheath 3*a* can be adjusted or predetermined via the filling pressure of the pressure mediator.

Figure 9:
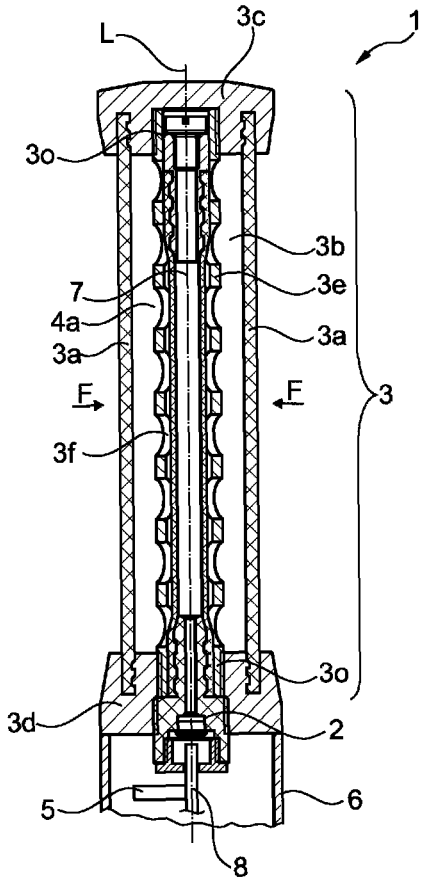
FIG. 9 shows a longitudinal section through a rod-shaped pressure sensor.

FIG. 2 also shows a pressure sensor 1 having a housing 6 with a mounting surface 6*b*, wherein the lower fixed portion 3*d* forms part of the housing 6. The lower fixed portion 3*d* is arranged in such a way that the hollow body 3 extends substantially perpendicularly with respect to the mounting surface 6*b*. The housing 6 also preferably accommodates an electronics unit 5, which is connected to the force transducer 2 by the cable 8. The pressure sensor 1 can, for example, be mounted on a wall via the mounting surface 6*b*. A seat part 21, which could be pushed under the pressure sensor 1, is not shown in FIG. 2. FIG. 9 shows a further embodiment of a pressure sensor 1 which, while being otherwise identical to that shown in FIGS. 2 to 6, differs from the embodiment in FIG. 2 in terms of being completely rod-shaped. FIG. 9 does not show the full length of the housing.

Figure 7A:
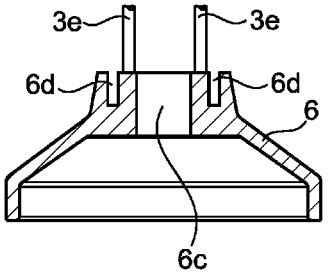
FIG. 7*a* shows a schematic longitudinal section through a further illustrative embodiment of a housing with spacer elements.
Figure 7B:
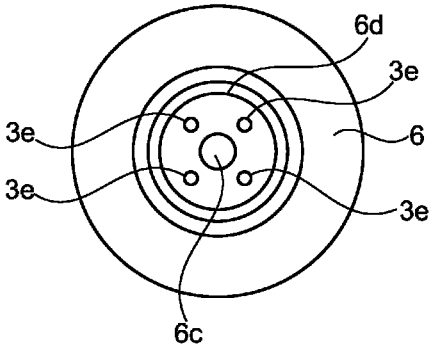
FIG. 7*b* shows a schematic plan view of FIG. 7*a;*

FIG. 7*a* shows a schematic and only partial view of a section through a housing 6 with bore 6*c* and recess 6*d*, while FIG. 7*b* shows a plan view of the housing 6. In the example shown, the spacer element 3*e* is composed of four pins which extend in the direction of extension L and connect the upper end part 3*c* to the lower end part 3*d*. The spacer element 3*e* can be produced in many possible ways in order to provide this spacing.

Figure 8:
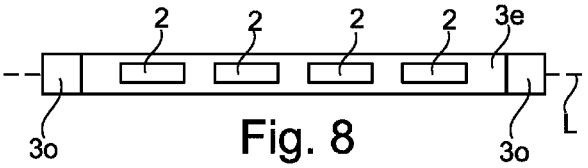
FIG. 8 shows a schematic side view of a further pressure-measuring device.

FIG. 8 shows a schematic view of a spacer element 3*e* and a pressure-measuring or force-measuring device 7, in which a plurality of force transducers 2 are arranged, spaced apart in the longitudinal direction L, on the spacer element 3*e*. Each force transducer 2 is connected to the electronics unit for signal transmission, such that the pressure exerted in the inner space 3*b* by the pressure mediator can be measured.

Figure 10:
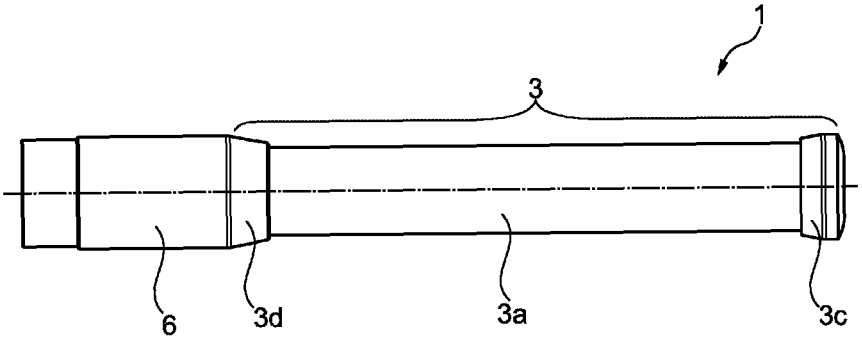
FIG. 10 shows a side view of the pressure sensor shown in FIG. 9.
Figure 11:
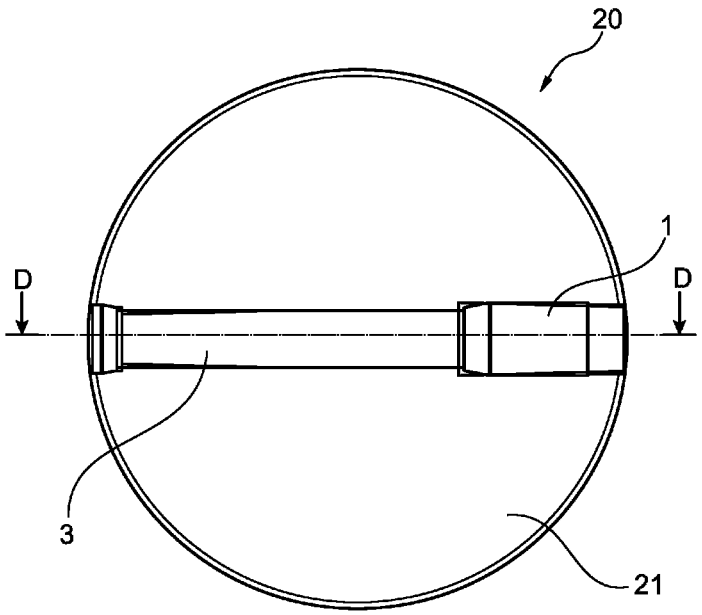
FIG. 11 shows a plan view of a training device.
Figure 12:
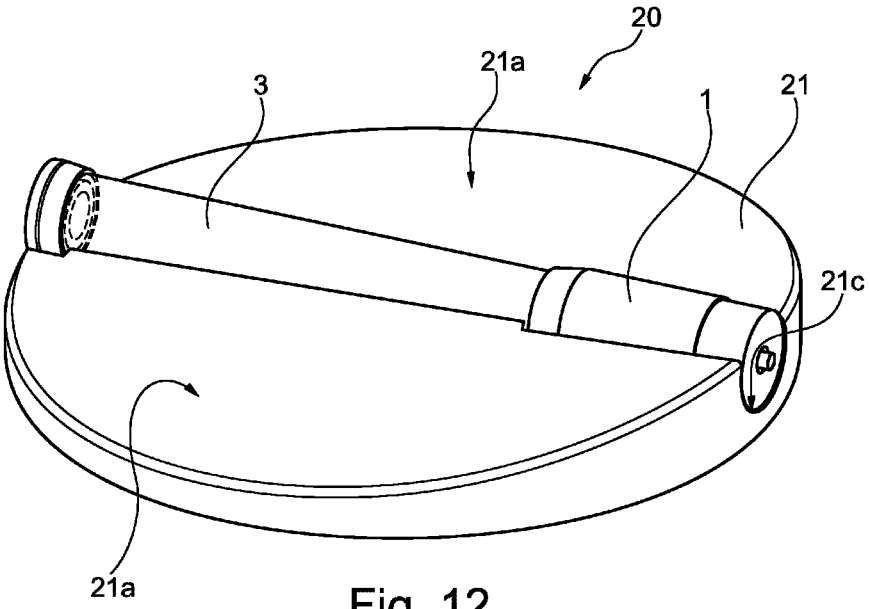
FIG. 12 shows a perspective view of the training device shown in FIG. 11.

FIG. 10 shows a side view of the pressure sensor 1 shown in FIG. 9, the full length of the housing 6 being shown in FIG. 10. FIG. 11 shows an illustrative embodiment of a training device 20 comprising a seat part 21 in which the pressure sensor 1 is arranged. FIG. 12 shows a perspective view of the training device 20 shown in FIG. 11. The seat part 21 has two seat surfaces 21*a*, between which a depression 21*c* is formed in order to receive the pressure sensor 1. FIG. 13 shows a section along the section line D-D according to FIG. 11. The depression 21*c* is made deep in the seat part 21 and is adapted with respect to the geometric design of the pressure sensor 1 in such a way that the hollow body 3 and in particular the elastic outer sheath 3*a* protrude at least partially above the seat surface 21*a* of the seat part 21.

The training device 20 is particularly advantageously designed in such a way that the seat part 21 and the pressure sensor 1 are designed as separate units that can be joined together and separated again. In a particularly advantageous embodiment, the pressure sensor 1 is placed loosely in the seat part 21.

The depression 21*c* of the seat part 21 is advantageously designed in such a way that the hollow body 3 can be placed in it in such a way that the hollow body 3 protrudes partially above the seat surface 21*a* of the seat part 21. In an advantageous embodiment, the depression 21*c* is designed matching the outer contour of the hollow body 3, such that, as is shown in FIG. 13, the hollow body 3 lies flat in the depression 21*c*, and in particular the elastic outer sheath 3*a* bears on the depression 21*c* along at least part of the length. Advantageously, the depression 21*c* extends in a manner corresponding to the outer contour of the elastic outer sheath 3*a*, such that the entire or substantially the entire part of the outer sheath 3*a* lying in the depression 21*c* preferably rests flat on the depression 21*c*. This embodiment has the advantage that the position of the part of the outer sheath 3*a* located in the depression 21*c* is precisely defined, such that the pressure forces acting on the remaining part of the outer sheath 3*a* can be reproduced particularly precisely and/or can be measured with minimal disturbances. As is shown in FIGS. 11 to 14, the depression 21*c* is preferably designed with an at least partial form fit in relation to the pressure sensor 1, which affords the advantage that the pressure sensor 1 is arranged in a defined position in the seat part 21. This is particularly advantageous if the pressure sensor 1 is designed as a part separate from the seat part 21 and the pressure sensor 1 or the seat part 21 can be exchanged. In another possible embodiment, however, the pressure sensor 1 can also be connected firmly to the seat part 21.

FIG. 14 shows a section through the training device 20 shown in FIG. 11, perpendicular to the pressure sensor 1. The pressure sensor 1 is placed into the depression 21*c* such that the pressure sensor 1 protrudes partially above the seat surface 21*a*. In one possible embodiment, a plurality of seat parts 21 are provided which have depressions 21*c* of different depths, such that, by an appropriate choice of one of the seat parts 21 in which the pressure sensor 1 is placed, it is possible to determine to what extent the pressure sensor 1 protrudes above the seat surface 21*a*, or, for example, in the case of an oblique seat surface 21*a*, how the pressure sensor 1 extends with respect to the seat surface 21*a*. In an advantageous embodiment, as shown for example in FIG. 14, the flexible outer sheath 3*a* can have an anatomically adapted outer shape. However, as is shown in FIG. 14, the anatomical adaptation can also be designed as a separate add-on part 19 and can be made, for example, from a flexible silicone. The outer sheath of the hollow body 3 has a cylindrical shape in FIG. 14. The add-on part 19 is placed on the hollow body 3 and can be exchanged. In one possible embodiment, the add-on part 19 could also be fixedly connected to the hollow body 3.

FIG. 15 shows a schematic view of the pelvic floor training device 20 in connection with a tracking device that comprises a calculator 24 and a screen 22. The pressure sensor 1 is connected to a computer 24 by a connection cable 24*b*. The computer 24 is connected to the screen by a connection cable 24*b*. A person who is training sits on the seat part 21, looks at the screen 22 and sees there a setpoint value profile 23 and also the currently measured actual value 23*a* as a function of time.

The pelvic floor training device is advantageously operated in such a way that a setpoint value 23 for the muscle tension of the pelvic floor muscle is predefined, that an actual value 23*a* is measured with the pressure sensor 1, and that the actual value 23*a* and/or the difference between actual value 23*a* and setpoint value 23 is output. As is shown in FIG. 15, a setpoint value profile 23 as a function of time is advantageously predefined and shown on a display device 22. The actual value 23*a* is measured by the pressure sensor and is shown as a function of time on the display device 22, such that the deviation between actual value and setpoint value is presented visually. By suitable contraction of the pelvic floor muscles, the person who is training can thus follow the setpoint value and can thereby train the pelvic floor muscles in a specific and controllable way. With the tracking device shown in FIG. 15, a large number of training programs or of different setpoint value profiles can be predefined. Moreover, progress made in training can be displayed.

The invention claimed is:

1. A pelvic floor training device for training human pelvic floor muscles, intended to be placed for training externally onto the human body directly or indirectly between the two ischial bones while seated, comprising:

a seat part; and a pressure sensor for detecting a muscle force;

wherein the pressure sensor comprises:

a pressure-measuring or force-measuring device; and a hollow body extending in a longitudinal direction, wherein the hollow body comprises a flexible outer sheath, an upper fixed end part, a lower fixed end part and a spacer element, wherein the upper end part and the lower end part are held spaced apart from each other by the spacer element extending in the longitudinal direction, whereby the flexible outer sheath of the hollow body connects the upper end part to the lower end part in such a way that an inner space is formed within which the spacer element is arranged, the inner space contains a gel material, an elastic multi-component material or a liquid material that acts as pressure mediator, wherein the pressure-measuring or force-measuring device extends in the longitudinal direction at least partially within the inner space in order to transmit the pressure from the flexible outer sheath to the pressure-measuring or force-measuring device via the pressure mediator;

wherein the seat part and the pressure sensor are designed as separate units that can be joined together and separated again, wherein the seat part and the pressure sensor are designed matching each other in such a way that the hollow body protrudes at least partially above a seat surface of the seat part; and wherein the seat part has a depression into which the hollow body can be placed.

2. The pelvic floor training device as claimed in claim 1, wherein the pressure-measuring or force-measuring device extends along a center of the hollow body.

3. The pelvic floor training device as claimed in claim 2, wherein the spacer element extends along a center axis of the hollow body.

4. The pelvic floor training device as claimed in claim 3, wherein the flexible outer sheath has a Shore hardness in the range of between 20 and 90.

5. The pelvic floor training device as claimed in claim 1, wherein the depression is designed matching an outer contour of the hollow body, so that the hollow body lies flat in the depression.

6. The pelvic floor training device as claimed in claim 5, wherein the seat surface extends obliquely.

7. The pelvic floor training device as claimed in claim 1, wherein the pressure measuring or force-measuring device extends at least along an entire length of the inner space.

8. The pelvic floor training device as claimed in claim 1, wherein the spacer element is designed as a hollow tube with wall openings, and wherein the pressure-measuring or force-measuring device is arranged extending inside the spacer element.

9. The pelvic floor training device as claimed in claim 1, wherein the flexible outer sheath is designed in a shape of a hollow cylinder.

10. The pelvic floor training device as claimed in claim 1, wherein the flexible outer sheath has an anatomically adapted outer shape.

11. The pelvic floor training device as claimed in claim 1, wherein an exchangeable add-on part is provided which is designed in such a way that it can be attached to the hollow body in a manner extending in the longitudinal direction of the latter.

12. The pelvic floor training device as claimed in claim 1, wherein a hardness or a pliability of the flexible outer sheath can be determined via the pressure of the pressure mediator.

13. The pelvic floor training device as claimed in claim 1, wherein the pressure-measuring or force-measuring device comprises:

a force transducer; and a flexible hollow body which extends rectilinearly in the direction of extent and has an inner space, the inner space is closed and contains a second liquid material, wherein the force transducer is coupled to the inner space in a manner perpendicular to the direction of extent in order to measure the pressure of the second liquid material.

14. The pelvic floor training device as claimed in claim 1, wherein the pressure-measuring or force-measuring device comprises a plurality of force transducers which are arranged, spaced apart from each other in the longitudinal direction, on the spacer element.

* * * * *